US005476406A

United States Patent [19]

Cheng

[11] Patent Number: 5,476,406

[45] Date of Patent: Dec. 19, 1995

[54] DECORATIVE FLOATING TOY

[76] Inventor: W.-Z. Cheng, No. 21, Alley 12, Lane 150, Shui Tien St., Shui Tien Li, Hsin Chu City, Taiwan

[21] Appl. No.: 367,075

[22] Filed: Dec. 30, 1994

[51] Int. Cl.[6] ..... A63H 33/00; G09F 19/02

[52] U.S. Cl. ..... 446/267; 40/406; 428/13

[58] Field of Search ..... 446/267, 166; 40/406, 407, 409, 410; 428/13, 3

[56] References Cited

U.S. PATENT DOCUMENTS 2,589,757 3/1952 Williams ..... 446/267
3,009,286 11/1961 Warner ..... 446/267 X
4,643,693 2/1987 Rubinstein ..... 40/406 X
5,292,564 3/1994 Lee ..... 428/13

FOREIGN PATENT DOCUMENTS 2215225 9/1989 United Kingdom ..... 446/267

*Primary Examiner*—Mickey Yu

[57] ABSTRACT

A decorative floating toy including a watertight container defining a water-tight holding chamber partially filled with a fluid, and a float floating on the fluid and of outer diameter fitting the water-tight holding chamber and having two tubes diagonally disposed at two opposite ends in reversed directions and communicated with each other for permitting the fluid to pass through the float when the water-tight container is turned upside-down.

4 Claims, 4 Drawing Sheets

DECORATIVE FLOATING TOY

BACKGROUND OF THE INVENTION

The present invention relates to a decorative floating toy having a float floating on a fluid in a water-tight container, wherein the float has a water passage for permitting the fluid to pass when the decorative floating toy is turned upside-down.

Various decorative floating toys have been disclosed, and have appeared on the market. These decorative floating toys commonly comprise a container, a fluid contained in the container, and floats floating on the fluid. When the decorative floating toys are turned upside-down, the floats quickly move from the bottom to the top. These decorative floating toys are monotonous and less attractive. There is another kind of decorative floating toy which comprises a power drive controlled to stir up the fluid, causing the floats moved on the fluid. Because this structure of decorative floating toy consumes electric power supply, it is not economic.

SUMMARY OF THE INVENTION

According to one aspect of the present invention, the decorative floating toy comprises a water-tight container partially filled with a fluid, and a float floating on the fluid, wherein the float has two tubes diagonally disposed at two opposite ends in reversed directions and communicated with each other for permitting the fluid to pass through the float when the water-tight container is turned upside-down.

According to another aspect of the present invention, the outer diameter of the float fits the inner diameter of the water-tight container so that the fluid is stopped from passing through the contact area between the water-tight container and the float when the decorative floating toy is turned upside-down.

According to still another aspect of the present invention, the water-tight container comprises two inside annular flanges to limit the moving distance of the float in the water-tight container and to keep the float in the fluid.

According to still another aspect of the present invention, the water-tight container further comprises two longitudinal inside grooves spaced from each other and respectively extended from the inside annular flanges for permitting the fluid to pass, wherein the depth of the longitudinal grooves are made gradually deeper toward each other.

According to a yet further aspect of the present invention, the float is made with a sand filter on the inside to improve the upward moving speed of the float when the decorative floating toy is turned upside-down.

DETAILED DESCRIPTION OF THE PREFERRED EMBODIMENT

Figure 1:
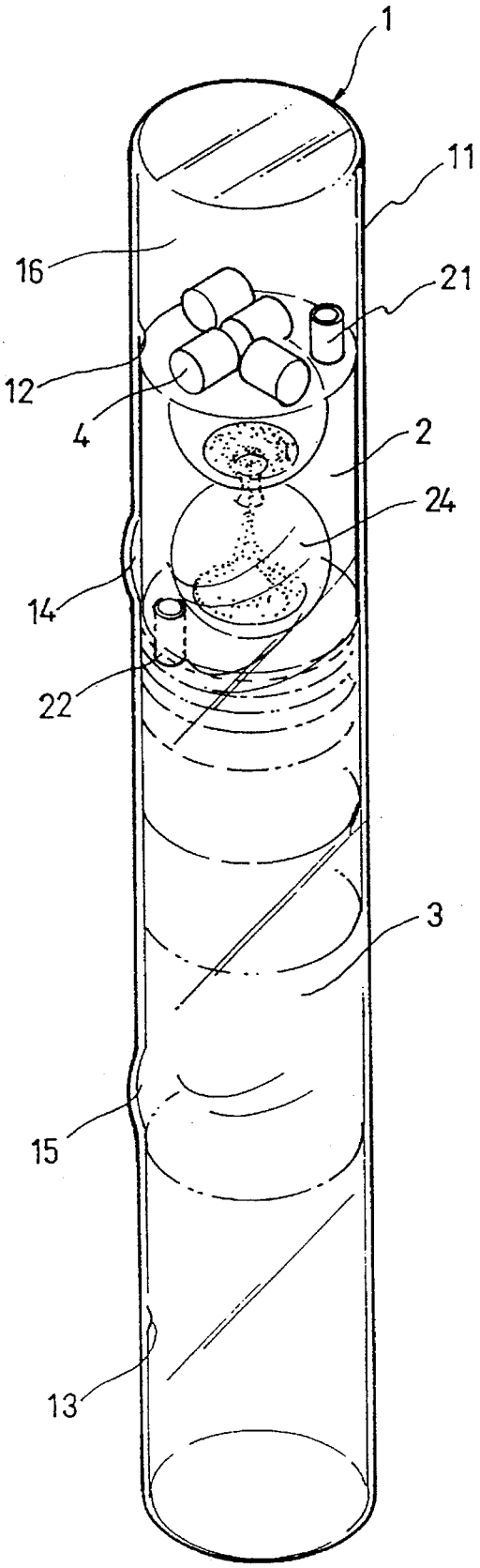
FIG. 1 is a perspective view of a decorative floating toy according to the present invention.
Figure 2:
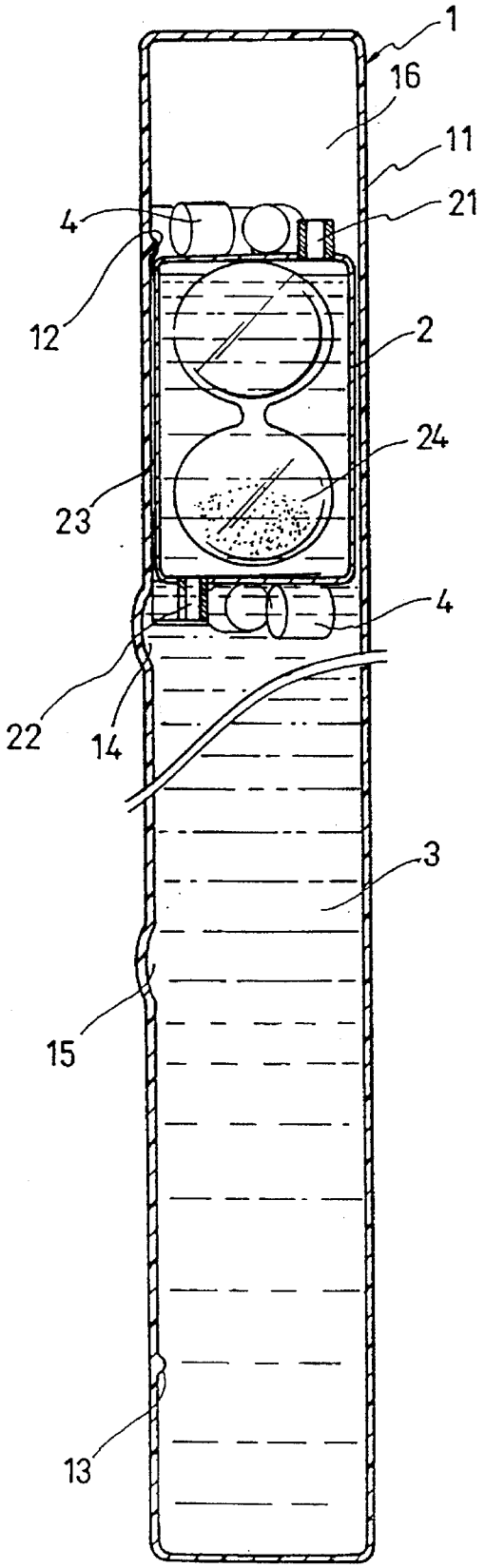
FIG. 2 is a longitudinal view in section of the decorative floating toy shown in FIG. 1.

Referring to FIGS. 1 and 2, a decorative floating toy in accordance with the present invention is generally comprised of a water-tight container 1, a fluid 3 contained in the water-tight container 1, a float 2 floating on the fluid 3, and a plurality of color blocks received inside the water-tight container 1. When the water-tight container 1 is filled with the fluid 3 and sealed, a suitable volume of air space 16 is left inside the water-tight container 1. The water-tight container 1 comprises a first inside annular flange 12 and a second inside annular flange respectively raised around the inside wall 11 and equally spaced from the two opposite ends, two longitudinal inside grooves 14 and 15 spaced from each other and respectively extended from the inside annular flanges 12 and 13 toward each other. The depth of the longitudinal inside groove 14 or 15 are gradually deeper from the inside annular flange 12 or 13. The float 2 comprises two tubes 21 and 22 diagonally disposed at two opposite ends in reversed directions and communicated with each other. When the decorative floating toy is disposed immovable, the air space 16 is maintained at the top, and the float 2 floats on the fluid 3 in the air space 16. Because of the constraint of the inside annular flanges 12 and 13, the float 2 can be maintained in the fluid 3.

Figure 3:
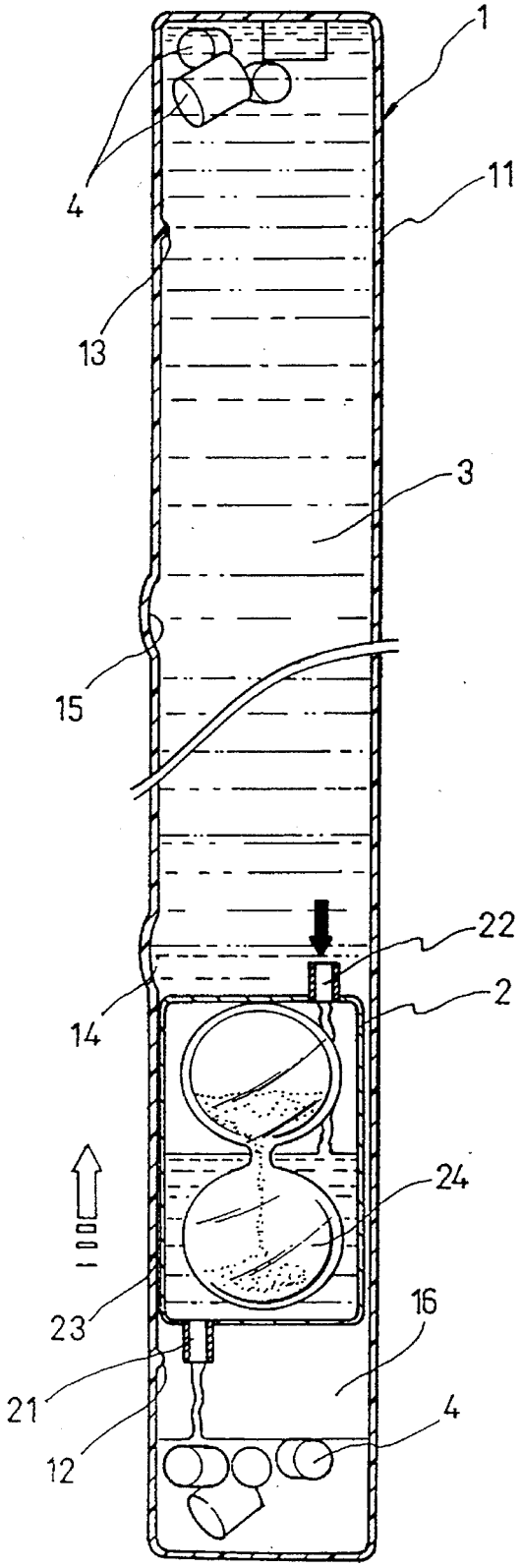
FIG. 3 is an applied view of the present invention, showing the decorative floating toy turned upside-down.
Figure 4:
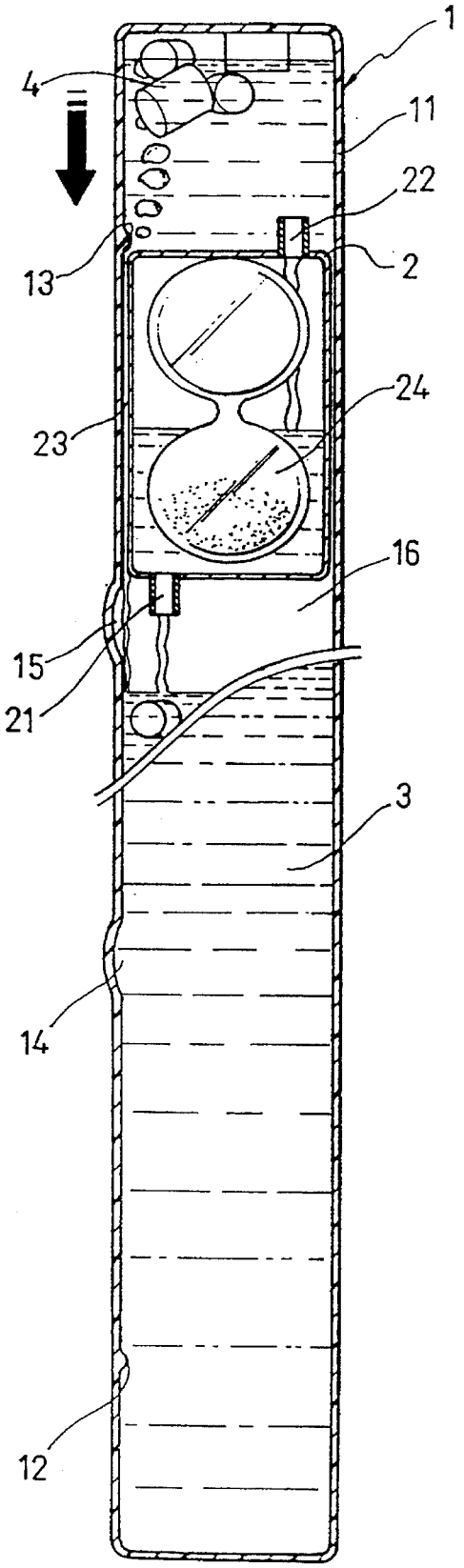
FIG. 4 shows another example of application of the present invention.

Referring to FIGS. 3 and 4, when the decorative floating toy is turned upright down, the positions of the float 2 and the air space 16 become changed to the bottom, however because air is lighter than the fluid 3, the fluid 3 gradually flows through the tubes 21 and 22 into the air space 16, causing the float 2 to move upwards. When the float 2 is moved away from the first inside annular flange 12 and stopped by the second inside annular flange 13, The inside diameter 23 of the water-tight container 1 permits the float 2 to pass. When the float 2 passes through the inside diameter 23, the fluid 3 is prohibited from passing through the inside diameter 23. However, when the float 2 passes through the longitudinal inside groove 14 or 15, the fluid 3 is allowed to pass through the gap between the longitudinal inside groove 14 or 15 and the float 2.

The decorative floating toy can be turned upside-down again and changed from the position shown in FIG. 3 to the position shown in FIG. 4. When the decorative floating toy is turned upside-down or from the inverted position to its former position, the color blocks 4 may be moved to the longitudinal inside groove 14 or 15 so that when the float 2 passes through the longitudinal inside groove 14 or 15, the color blocks 4 become changed from one side to another relative to the float 2. Furthermore, a sand filter 24 may be made inside the float 2 to improve the upward moving speed of the float when the decorative floating toy is turned upside-down.

While only one embodiment of the present invention has been shown and described, it will be understood that various modifications and changes could be made without departing from the spirit and scope of the invention.

What is claimed is:

1. A decorative floating toy comprising a water-tight container defining a water-tight holding chamber having an inside diameter and partially filled with a fluid, and a float floating on said fluid inside said water-tight container and of an outer diameter closely and slidably fitting said inside diameter of said water-tight holding chamber, said float-having two tubes diagonally disposed at two opposite ends in reversed directions and in fluid communication with each other for permitting said fluid to pass through said float when said water-tight container is turned upside-down.

2. The decorative floating toy of claim 1 wherein said water-tight container comprises two inside annular flanges spaced from two opposite ends thereof to limit the movement of said float between said inside annular flanges and to keep said float in said fluid.

3. The decorative floating toy of claim 2 wherein said water-tight container comprises two longitudinal inside grooves spaced from each other and respectively extended from said inside annular flanges for permitting said fluid to pass between said float and said container when said float is located adjacent a respective one of said inside grooves, the depth of said longitudinal grooves being made gradually deeper toward each other.

4. The decorative floating toy of claim 1 wherein said float comprises a sand filter on the inside.

* * * * *